US007426845B2

(12) United States Patent
DiCesare

(10) Patent No.: US 7,426,845 B2
(45) Date of Patent: Sep. 23, 2008

(54) HYDROFORMING APPARATUS AND METHOD OF ASSEMBLING SAME

(75) Inventor: John DiCesare, Bowling Green, KY (US)

(73) Assignee: Magna International Inc., Aurora, Ontario (CA)

( * ) Notice: Subject to any disclaimer, the term of this patent is extended or adjusted under 35 U.S.C. 154(b) by 345 days.

(21) Appl. No.: 10/534,320

(22) PCT Filed: Nov. 11, 2003

(86) PCT No.: PCT/US03/35843

§ 371 (c)(1),
(2), (4) Date: Oct. 3, 2005

(87) PCT Pub. No.: WO2004/043622

PCT Pub. Date: May 27, 2005

(65) Prior Publication Data

US 2006/0137417 A1 Jun. 29, 2006

Related U.S. Application Data

(60) Provisional application No. 60/425,273, filed on Nov. 12, 2003.

(51) Int. Cl.
*B21D 26/02* (2006.01)
*B21D 39/20* (2006.01)

(52) U.S. Cl. ..... 72/58; 72/62; 72/370.22

(58) Field of Classification Search ..... 72/57, 72/58, 60, 61, 62, 352, 353.2, 354.6, 357, 72/358, 370.22
See application file for complete search history.

(56) References Cited

U.S. PATENT DOCUMENTS

| | | | | | |
|---|---|---|---|---|---|
| 567,518 | A | * | 9/1896 | Simmons | 72/57 |
| 1,602,282 | A | * | 10/1926 | Methlin | 89/14.7 |
| 3,751,954 | A | * | 8/1973 | Ezra et al. | 72/56 |
| 4,106,322 | A | * | 8/1978 | Moshnin et al. | 72/356 |
| 4,638,538 | A | * | 1/1987 | Kohama et al. | 72/357 |
| 4,693,103 | A | * | 9/1987 | Hellgren | 72/63 |
| 5,321,964 | A | * | 6/1994 | Shimanovski et al. | 72/62 |
| 5,575,172 | A | * | 11/1996 | Bonny et al. | 72/357 |
| 6,014,879 | A | * | 1/2000 | Jaekel et al. | 72/61 |

* cited by examiner

*Primary Examiner*—David B Jones
(74) *Attorney, Agent, or Firm*—Clark Hill PLC

(57) ABSTRACT

A hydroforming apparatus includes a hydroforming die member and a hydroforming press. A fastener couples the press to the die member, the fastener having a shaft and a shoulder. A spacer positioned on the fastener spaces the die member from the press. The shaft is secured to the press housing. The shoulder is positioned within a slot in the die member configured to receive the shoulder as the shoulder is inserted into the slot in a direction transverse to a longitudinal axis of the fastener.

15 Claims, 4 Drawing Sheets

HYDROFORMING APPARATUS AND METHOD OF ASSEMBLING SAME

RELATED APPLICATION

The present application claims priority to all the benefits from U.S. provisional application No. 60/425,273, filed Nov. 12, 2003.

BACKGROUND OF THE INVENTION

1. Field of the Invention

The present invention relates to hydroforming apparatuses and methods therefore. More specifically, the illustrated embodiments of the present invention relate to the connection between hydroforming presses and hydroforming die assemblies and methods therefore.

2. Description of the Related Art

Hydroforming is a forming process in which one or more hydroforming presses are used to shape a blank disposed within a hydroforming die assembly. Hydroforming presses are coupled to hydroforming die assemblies to provide a force exertion. In the prior art, connecting rods are threaded directly into a hole in the die assemblies making connection between die halves and hydroforming presses difficult and time consuming, and requiring excessive manpower.

SUMMARY OF THE INVENTION

According to one aspect of the invention, there is provided a hydroforming apparatus comprising a hydroforming die member and a hydroforming press having a housing. A fastener assembly comprising a fastener having a shaft terminating at a shoulder is used to connect the die member and housing. The shoulder forms a head. A spacer is disposed about the fastener for separating the die member and housing a specified distance. The fastener is secured to the press housing at one end of the shaft and the shoulder of the fastener is received within a slot formed in the die member for connecting the die member and press.

According to another aspect of the invention, there is provided a method of attaching a hydroforming press to a hydroforming die member comprising: providing a hydroforming die member; providing a hydroforming press having a housing; providing a fastener assembly comprising a fastener having a longitudinal axis and a shaft terminating at a shoulder which forms a head. A spacer is disposed about the fastener and a nut is attached to the shaft of the fastener. The is also included the step of providing the die member with a slot configured to receive the shoulder in a direction that is transverse to the longitudinal axis of the fastener. Also included are the steps of providing a spacer disposed about the fastener; securing the shaft of the fastener to the housing; and positioning the shoulder of the fastener within the slot in the die member by moving the shoulder and the fastener in a direction that is transverse to the longitudinal axis of the fastener.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE EMBODIMENTS

Figure 1:
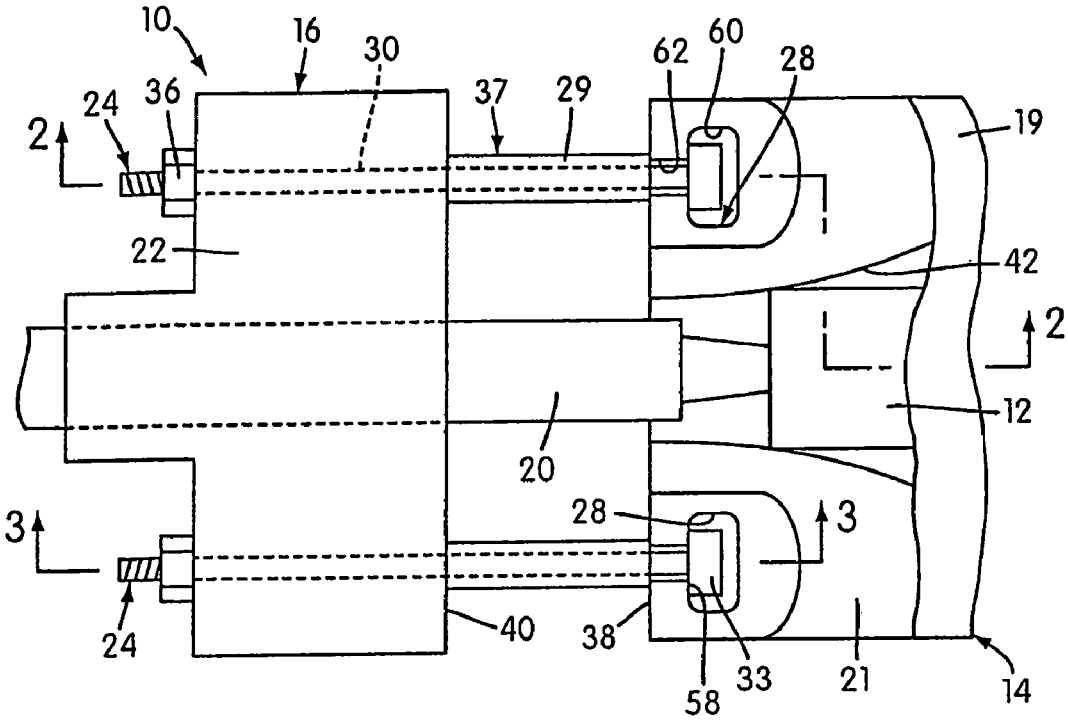
FIG. 1 is plan view of a die assembly of a hydroforming apparatus in accordance with one illustrated embodiment of the present invention with the upper die partially cut away and showing a press housing of a hydroforming press of the hydroforming apparatus removably coupled to the lower die member.
Figure 3:
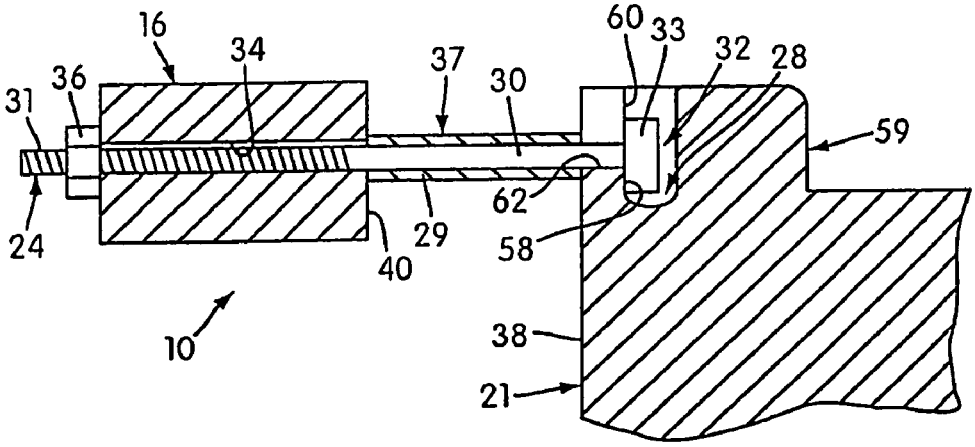
FIG. 3 is a cross-sectional view through line 3-3 of FIG. 1.
Figure 2:
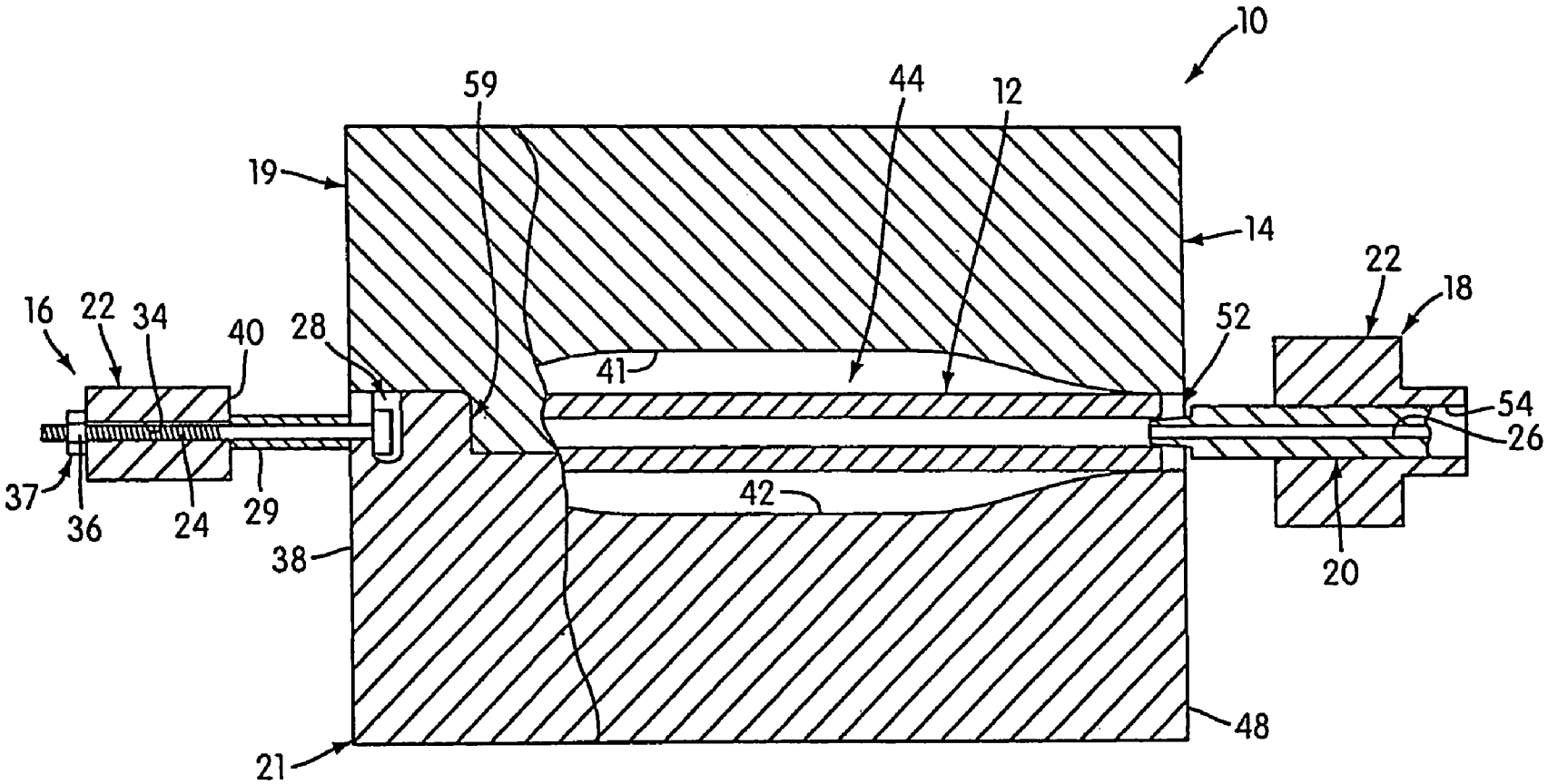
FIG. 2 shows a cross-sectional side view of the hydroforming apparatus through line 2-2 in FIG. 1 and showing the tubular blank within the apparatus.

FIGS. 1-3 show an illustrative embodiment of an apparatus 10 according to one aspect of the present invention for hydroforming a tubular metal blank 12. The hydroforming apparatus 10 includes a hydroforming die assembly 14 and a pair of hydroforming presses 16, 18 mounted on opposite sides of the die assembly 14. The die assembly 14 includes an upper die member 19 and a lower die member 21. The hydroforming presses 16 and 18 are removably and replaceably attached to lower die member 21 through the use of fasteners 24 having heads 33 and shafts 30 that can be lowered into slots 28 to connect the presses 16 and 18 to the lower die member 21 once the fasteners 24 are tightened. The presses 16 and 18 are then removable by loosening the fasteners 24 and then raising the fasteners 24 to disengage the heads 33 and shafts 30 from the slots 28. This configuration facilitates the connection and disconnection between the hydroforming presses and die members.

The upper and lower die members 19, 21 are constructed of a metallic material such as steel and are shaped to include respective die surfaces 41, 42. The die surfaces 41, 42 cooperate to form a die cavity 44 when the die members 19, 21 are in their closed position (see FIG. 1). The die cavity 44 forms a continuous passageway that extends from one side 38 of the die assembly 14 to another side 48 of the die assembly 14. Each end of the die cavity 44 forms an opening 52 in a respective side 38, 48 of the die assembly 14.

Figure 4:
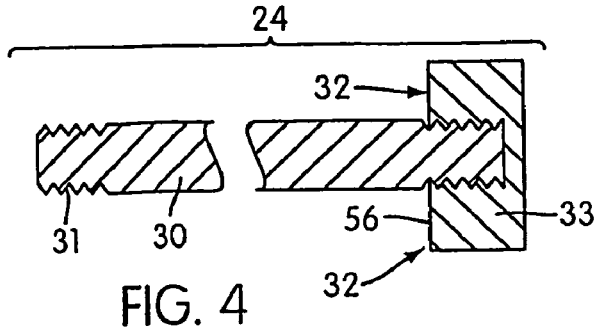
FIG. 4 is a cross-sectional view of a fastener used in FIG. 1.
Figure 5:
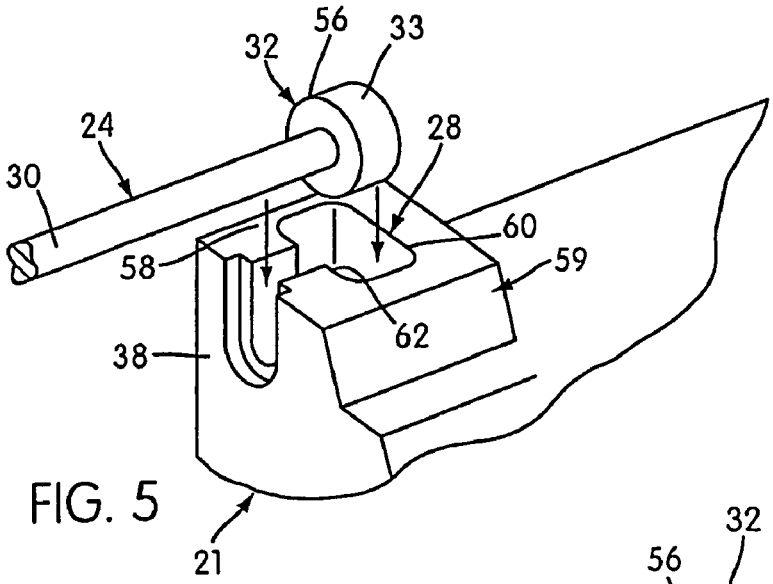
FIG. 5 is an enlarged perspective view of a portion of the lower die member of FIG. 1 showing a slot therein and showing a portion of the fastener in exploded relation therewith.

Each slot 28 can be formed in the lower die member 21 by machining or other suitable method. Each slot 28 is keyhole-shaped and is formed in an upwardly projecting structure 59 integrally formed on the lower die member 21. Each slot 28 includes a relatively wider portion 60 and a relatively narrower portion 62. The fastener 24, as shown in FIG. 4, is inserted into the slot 28 through a keyhole-shaped top opening 64 in the slot 28. As shown in FIG. 5, the wider portion 62 of each slot 28 is configured to receive the head 33 and shoulder portions 32 of a respective fastener 24. Each slot 28 includes transversely extending wall surfaces 58 that abuttingly engage the annular surface 56 of the shoulder portion 32 of the fastener 24 when the nut 36 is tightened. Thus, each slot 28 is configured to receive and abuttingly engage the shoulder portion 32 as the fastener 24 is inserted into the slot 28 in a direction that is transverse to the longitudinal axis of the fastener. When the upper die member 19 is placed on the lower die member 21, the upper die member 19 covers the top opening 64 into each slot 28 to retain each fastener 24 in its associated slot 28. Also, separate covers can be used to cover the connection between the fasteners 24 and the slots 28, such as metal plates that attach directly to the lower die member 21.

Figure 6:
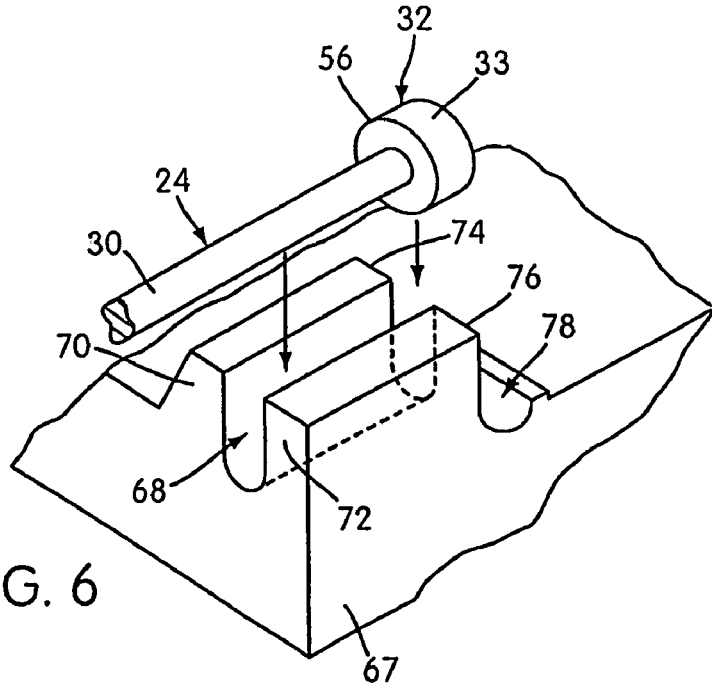
FIG. 6 is a view similar to FIG. 5 except showing another illustrative embodiment of a slot formed in a lower die member.

Another illustrative embodiment of a slot 68 is shown in FIG. 6. Slot 68 is provided by a pair of upwardly projecting integral wall structures 70, 72 integrally formed on a lower die member 67. The shoulder portion 32 of the head 33 abuttingly engages surfaces 74, 76 on the wall structures 70, 72, respectively, when a fastener 24 is disposed in the slot 68. A transversely extending groove 78 is formed adjacent the wall structures 70, 72 and receives a portion of the head 33 of the fastener 24. The embodiment of FIG. 6 permits greater leeway in the initial positioning of the head 33 when positioning the fastener 24 in slot 68. When an upper die member is placed on the lower die member 67, the upper die member covers the top opening of the slot 68. Also, separate covers can be used to cover the connection between the fasteners 24 and the slots 68, such as metal plates that attach directly to the lower die member 67. Except for the configuration of slot 68, the die assembly of lower die 67 and its corresponding hydroforming press function in a manner substantially identical to that described above with respect to the embodiment of FIG. 5.

It can be appreciated that the positioning of an upper die member in covering relation over a slot in a lower die member such as slot 28 or slot 68 is not required to maintain a fastener assembly in engagement with the slot and therefore in releasably coupled engagement with the die assembly. Thus, the die assembly 14 can be opened and closed, for example, to place a blank inside the die assembly or to remove a hydroformed member from the die assembly.

The hydroforming presses 16, 18 are of identical construction to one another in the illustrative embodiment, although this is not required, so the following discussion will focus primarily on press 16, but the discussion applies equally to press 18. Each hydroforming press 16, 18 includes a hydraulically driven, tube end-engaging structure 20 and a press housing 22. The present invention is primarily concerned with the manner in which each hydraulic press 18, 20 and each press housing 22 is removably coupled to the die assembly 14. The details of the construction and operation of each of the hydroforming presses 16, 18 and of the components thereof, including the tube engaging structures 20, the pressure intensifying structures, and the hydraulic power source, are not considered in detail herein but can be as described in commonly assigned U.S. Pat. No. 6,014,879 to Jaekel et al., the entirety of which is hereby incorporated by reference into the present application for all material disclosed therein. Generally, the tube engaging structure 20 is mounted in the press housing 22 for longitudinal movement with respect to the die assembly 14 and the press housing 22. The press housing 22 is removably mounted on the die assembly 14 by fasteners 24 in a manner described below (see FIGS. 2 and 3, for example).

Each press housing 22 includes a hydraulic cylinder as is generally known in the art and may be constructed to support and guide the associated tube engaging structure 20 as its specially adapted piston and to align the associated tube engaging structure 20 with the adjacent opening 52 of the die cavity 44 so that each tube engaging structure 20 enters and abuttingly engages a respective end of the tubular blank 12 within the die cavity 44.

Figure 7:
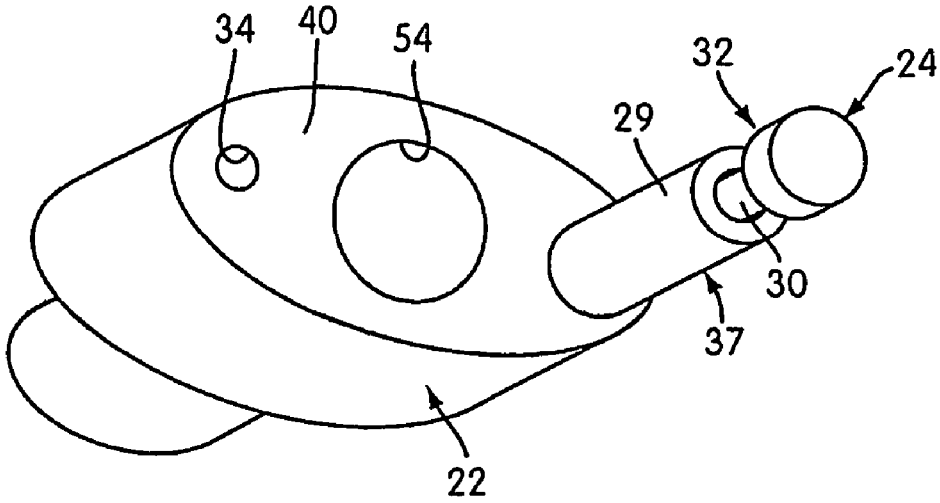
FIGS. 7 and 8 are perspective views of the press housing of FIG. 1 and a fastener assembly mounted therein.
Figure 8:
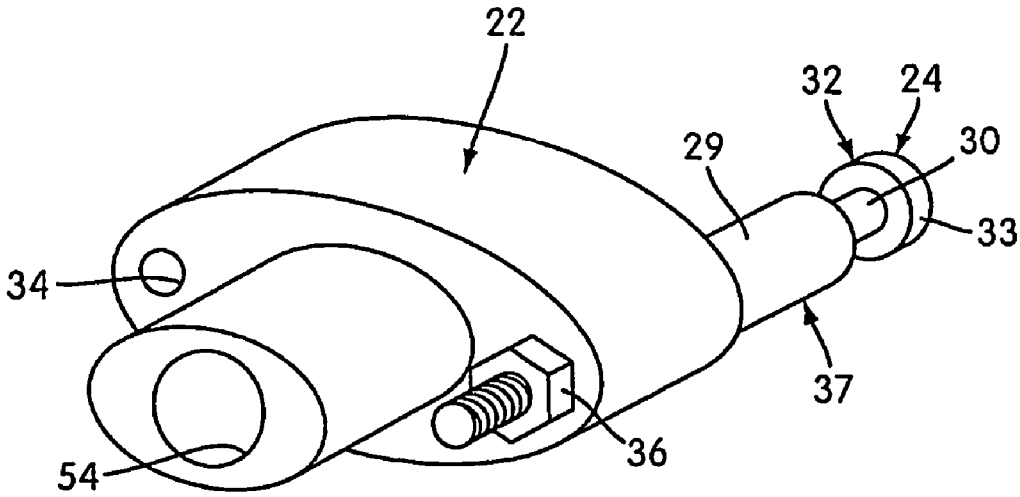

FIGS. 7 and 8 show, schematically and in isolation, the press housing 22 and a fastener assembly 37 loosely engaged therewith. The press housing 22 is in a configuration to be mounted on a side of the die assembly 14.

The tube engaging structure 20 is operatively connected to a hydraulically driven pressure intensifying structure such as a hydraulic cylinder, and to a hydraulic power source. During a hydroforming operation, the tube engaging structure 20 seals an end of the blank 12 and transmits a hydroforming fluid received from the fluid source through a fluid supplying passageway 26 into the interior of the blank 12. The pressure intensifying structure increases the pressure of the hydroforming fluid in the interior of the blank 12 which expands the blank 12 into conformity with die surfaces within the die assembly 14. The tube engaging structure 20 is movable in a longitudinal direction under hydraulic power with respect to the press housing 22 and the die assembly 14 to longitudinally compress the blank 12 during hydroforming.

The manner in which each press housing 22 is removably coupled to the die assembly 14 can be understood from FIGS. 1-5. The lower die member 21 includes a pair of slots 28 on each side thereof. A pair of fasteners 24 removably couple each press housing 22 to a pair of slots 28 on the die assembly 14. A pair of spacers 29 are disposed between each press housing 22 and the die assembly 14 and are operable to space the press housing 22 from the die assembly 14 and to align the press housing 22 with the die assembly 14. The fasteners 24 are structurally identical to one another and the spacers 29 are structurally identical to one another in the illustrated embodiment, although this is not required by the invention. Therefore, the fasteners 24 and associated structures and the spacers 29 are identified respectively by identical reference numbers.

Each fastener 24 includes a grip portion in the form of a longitudinally extending shaft 30 with a threaded end 31 and includes a shoulder portion 32 in the form of a head 33 mounted on the shaft 30. Each spacer 29 is a tubular metallic sleeve that is mounted around the shaft 30 of each fastener 24. Each fastener 24 extends through an aperture 34 in the press housing 22 and is secured to the press housing 22 by a locking crown nut 36. Although fastener 24 is illustrated as being tightened by nut 36, any appropriate fastener and tightening mechanism can be used so long as it sufficiently and securely tightens the presses 16 and 18. Each fastener 24 loosely fits within an aperture 34 in the housing 22, although this is not a requirement of the invention. That is, the inner diameter of the aperture 34 is sufficiently larger than the outer diameter of the fastener 24 to allow transverse movement of the fastener 24 with respect to the aperture 34. Each fastener 24, nut 36 and spacer 29 comprises a fastener assembly 37.

As shown in FIG. 4, the head 33 and the shaft 30 of each fastener 24 are separate structures in the illustrative embodiment (see FIG. 4). The head 33 is a cylindrical structure that is threadedly engaged with the shaft portion 31. Both the head 33 and the shaft 30 of the fastener 24 are integral structures that are constructed of a metallic material such as steel. An underside of the head 33 provides an annular surface 56 which forms the shoulder portion 32 of the fastener 24. Of course, fastener 24 can be made of various configurations, such as a one-piece, integral member, and other types of fasteners that achieve the same results of being appropriately inserted into a die half and then tightened can be employed.

With reference again to FIGS. 1-3, 7 and 8, each spacer 29 is constructed of a metallic material such as steel and abuttingly engages surfaces on the press housing 22 and the die assembly 14 when the fastener assemblies 37 are tightened. The spacers 29 are operable to align the central passageway 54 of the press housing 22 with an adjacent end portion of the die cavity 44 and to space the press housing 22 a predetermined distance from the die assembly 14.

The press housing 22, the fastener 24, the spacer 29, and the nut 36 can be heavy and cumbersome depending on the size of the die assembly 14 and the blank 12 to be hydroformed. For example, the shaft 30 portion of each fastener 24 may weight 50-75 pounds and each locking crown nut 36 may weight 50-75 pounds. The present invention simplifies handling of these and other components because the fastener assemblies 37 do not have be removed from a press housing 22 once installed therein. More specifically, prior to installation of a press housing 22 on a side of the die assembly 14, each fastener 24 is loosely held on the press housing 22 by a nut 36. The spacers 29 are loosely disposed on the shafts 30. A press housing 22 is lifted above the lower die member 21 and then lowered such that the pair of fasteners 24 on the press housing 22 move into a pair of slots 28 on a side of the lower die member 21 as seen in FIGS. 1-3 and 5 as the spacers 29 are provided with sufficient room to move along the shaft 30 of the fastener 24 to provide enough clearance between the head 32 and the spacer 29 to permit the wall of the slot 28 to pass therebetween. When the press housing 22 is mounted on the die assembly 14, the pair of spacers 29 are positioned between a side 38 of the die assembly 14 and a side 40 of the press housing 22. Each nut 36 is tightened to a specified tightness to secure the press housing 22 to the die assembly 14. The press housing 22 can be removed by loosening each nut 36 and lifting the fasteners 24 out of the slots 28.

Because the fastener assemblies 37 remain loosely attached to the press housing 22 as the press housing 22 is being installed on or removed from the die assembly 14, there are no separate parts during installation, removal, handling, or subsequent reinstallation of the press housing 22. The fastener assemblies 37 enable a single worker to quickly and safely install, remove, handle, and reinstall a press housing 22 on a die assembly 14. The individual components that comprise the fastener assemblies 37 do not have to be handled separately during installation and removal of a press housing 22 from a die assembly 14.

Operation

To couple hydroforming presses 16, 18 to the lower die member 21 of the die assembly 14, the die assembly 14 is opened so the upper die member 19 is spaced from the lower die member 21 to expose the slots 28 in the lower die member 21. Each press housing 22 and the associated fastener assemblies 37 are lifted above the lower die member 21 (by, for example, a single worker operating a crane) and positioned so that the fastener assemblies 37 are aligned with the associated slots 28.

The spacers 29 are spaced from the shoulder portion 32 so that the head 33 of each fastener assembly 37 and the adjacent shaft 30 portion can be lowered into the wide and narrow portions 60, 62, respectively, of the slots 28. The fastener assemblies 37 of each press housing 22 are lowered into respective slots 28, thereby positioning the shoulder 32 of each fastener 24 within a slot 28 in the lower die member 21 by moving the shoulder 32 and the fastener 24 in a direction that is substantially transverse to the longitudinal axis of the associated fastener 24.

Each spacer 29 is positioned generally between the press housing 22 and a side of the die assembly 14 when the fastener assemblies 37 are in their respective slots 28. The fastener assemblies 37 can be tightened by tightening each nut 36 with an appropriate tool. The die assembly 14 may be moved into its closed position before tightening each nut 36, although this is not required by the invention. Thus, each nut 36 can be tightened prior to closing the die assembly 14.

A tube engaging structure 20 of the hydroforming presses 16, 18 is moved into each press housing 22 once the press housings 22 are secured to the die assembly 14. A blank 12 is placed in the die assembly 14 and is subject to hydroforming. The press housings 22 can remain attached to the lower die member 21 of the die assembly 14 as the die assembly 14 is opened and closed. That is, each press housing 22 can remain attached to the lower die member 21 until the fastener assemblies 37 are loosened by a worker.

Each press housing 22 can be removed by following essentially the reverse procedure. That is, the nut 36 of each fastener assembly 37 can be loosened and the associated press housing 22 can be lifted away from the lower die member 21 with the fastener assemblies 37 attached to the press housing 22. The fastener assemblies are lifted out of the lower die member 21 or 67 in a direction that is substantially transverse to the longitudinal axis of the fasteners 24. Because the fastener assemblies 37 are coupled to the press housing 22, the fastener assemblies 37 provide a way for a single worker to quickly change which press housing 22 is coupled to a particularly die assembly. A die assembly can be quickly reconfigured by changing the particular press housings 22 that are coupled thereto so that a wide range of different tube engaging structures (or "hydraulic cylinders") can be used on a particular die assembly. Also, it permits housing 22 to be used with different die assemblies. Thus, fewer sets of hydraulic cylinders are thus required which reduces manufacturing costs.

It can be appreciated that the illustrative embodiments of the present invention are intended to illustrate principles of the invention and are not intended to limit the scope of the invention to the specific embodiments illustrated. Many other structures could be constructed to provide a spacing function, therefore many variations are contemplated. For example, although the spacers are mounted on the fasteners, it can be understood that this specific construction is not required by the invention. In other embodiments, the spacers can be provided by one or more members that are spaced from the fasteners and are permanently or removably attached to the press housing or to the die assembly.

Thus, while the invention has been disclosed and described with reference with a limited number of embodiments, it will be apparent that variations and modifications may be made thereto without departure from the spirit and scope of the invention and various other modifications may occur to those skilled in the art. Therefore, the following claims are intended to cover modifications, variations, and equivalents thereof.

What is claimed is:

1. A hydroforming apparatus (10) comprising:

a hydroforming die assembly (14) comprising an upper die and a lower die (19, 21), said upper die and lower die cooperating to form a die cavity therebetween, said lower die having a pair of slots, said pair of slots positioned adjacent an end portion of the die cavity;

a hydroforming press (16, 18) having a tube engaging structure moving through a housing (22);

a fastener assembly (37) comprising a pair of fasteners, each fastener (24) having a shaft (30) terminating at a shoulder (32), the shoulder forming a head (33), and a spacer (29) disposed about the fastener (24);

each of the fasteners (24) being secured to the press housing (22) at one send of the shaft (30) and the shoulder (32) of the fastener (24) received within one of said pair of slots (28) formed in the lower die (21) for connecting the lower die (21) and press (16, 18) and aligning the tube engaging structure with the end portion of the die cavity, and the spacer (29) extending between the lower die (21) and press housing (22) to space the press housing (22) a predetermined distance from the lower die (21).

2. The hydroforming apparatus (10) of claim 1 wherein the first end of the shaft (30) comprises a threaded end (31) for mating with a nut (36).

3. The hydroforming apparatus (10) of claim 1 wherein the slot (28) has a keyhole structure and is formed in an upwardly projecting structure (59) formed in the lower die member (21).

4. The hydroforming apparatus (10) of claim 1 wherein the slot (28) comprises a wider portion (60) and a narrower portion (62) both having a top opening (64).

5. The hydroforming apparatus (10) of claim 4 wherein the wider portion (60) is configured to receive the shoulder (32) of the fastener (24).

6. The hydroforming apparatus of claim 1 wherein the slot (28) includes transversely extending wall surfaces (58) for engaging an annular surface (56) of the shoulder (32).

7. The hydroforming apparatus of claim 1 wherein a slot (68) comprises a pair of upwardly projecting structures (70, 72) integrally formed on a lower die member (67).

8. The hydroforming apparatus of claim 7 including a transversely extending groove (78) formed adjacent the structures (70, 72) for receiving a portion of the head (33) of the fastener (24).

9. The hydroforming apparatus of claim 1 wherein the fastener assembly (37) is loosely attached to the press housing (22) for allowing a single person to configure a press housing (22) and die member (14).

10. A method of attaching a hydroforming press (16, 18) to a hydroforming die member (14), comprising:

providing a hydroforming die member (14);

providing a hydroforming press (16, 18) having a housing (22);

providing a fastener assembly (37) comprising a fastener (24) having a longitudinal axis and a shaft (30) terminating at a shoulder (32), the shoulder forming a head (33), and a nut (36);

providing the die member (14) with a slot (28) configured to receive the shoulder (32) in a direction that is transverse to the longitudinal axis of the fastener (24);

providing a spacer (29) disposed about the fastener (24) to space the die member (14) relative to the press housing (22);

securing the shaft (30) of the fastener (24) to the housing (22); and positioning the shoulder (32) of the fastener (24) within the slot (28) in the die member (14) by moving the shoulder (32) and the fastener (24) in a direction that is transverse to the longitudinal axis of the fastener (24).

11. The method of attaching a hydroforming press (16, 18) to a hydroforming die member (14) of claim 10 including the step of positioning the spacers (29) between a side (38) of the die member (14) and a side (40) of the press housing (22) to engage the die member (14) and the press housing (22).

12. The method of attaching a hydroforming press (16, 18) to a hydroforming die member (14) of claim 10 including the step of tightening nuts (36) to a specified level to secure the die member (14) to the press housing (22) after positioning the shoulder (32) within the slot (28).

13. The method of attaching a hydroforming press (16, 18) to a hydroforming die member (14) of claim 12 including the step of positioning a tube engaging structure (20) within the press housing (22) following the step of tightening the nuts (36).

14. The method of attaching a hydroforming press (16, 18) to a hydroforming die member (14) of claim 13 including the step of performing a hydroforming operation following the step of positioning the tube engaging structure (20).

15. A hydroforming apparatus comprising:

a hydroforming die assembly including an upper die and a lower die, said upper die and lower die cooperating to form a die cavity therebetween, said lower die having a pair of slots, said pair of slots positioned adjacent an end portion of said die cavity;

a hydroforming press having a tube engaging structure moving through a housing;

a pair of fastener assemblies, each one of said pair of fastener assemblies including a fastener having a shaft extending between a shoulder end and a threaded end for mating with a nut, and a spacer disposed about said shaft;

each said fastener secured to said housing at said threaded end of said shaft by said nut and said shoulder of said fastener received within one of said pair of slots formed in said lower die for connecting said lower die and said hydroforming press and aligning said tube engaging structure with said end portion of said die cavity, wherein said spacer extends between and directly abuts said lower die and said housing to space said housing a predetermined distance from said lower die.

* * * * *